US012774578B2

(12) United States Patent
Harper

(10) Patent No.: US 12,774,578 B2
(45) Date of Patent: Oct. 27, 2026

(54) UNDERGROUND UTILITY ENCLOSURE SYSTEM AND METHOD

(71) Applicant: Donald S. Harper, Baton Rouge, LA (US)

(72) Inventor: Donald S. Harper, Baton Rouge, LA (US)

( * ) Notice: Subject to any disclaimer, the term of this patent is extended or adjusted under 35 U.S.C. 154(b) by 594 days.

(21) Appl. No.: 18/243,408

(22) Filed: Sep. 7, 2023

(65) Prior Publication Data

US 2025/0084606 A1 Mar. 13, 2025

(51) Int. Cl.
*E02D 29/14* (2006.01)

(52) U.S. Cl.
CPC ..... *E02D 29/1472* (2013.01); *E02D 2200/12* (2013.01); *E02D 2250/0023* (2013.01); *E02D 2300/0015* (2013.01); *E02D 2300/0017* (2013.01); *E02D 2300/0026* (2013.01)

(58) Field of Classification Search
CPC . E02D 29/1472; E02D 29/14; E02D 2200/12; E02D 2250/0023
See application file for complete search history.

(56) References Cited

U.S. PATENT DOCUMENTS 3,390,224 A * 6/1968 Wyatt ..... H02G 9/10 285/55
3,390,225 A * 6/1968 Couch ..... H02G 9/10 174/663
3,672,103 A 6/1972 Kost
3,916,590 A * 11/1975 Miller ..... E04H 13/00 52/124.2
3,974,599 A 8/1976 Grosh
4,737,220 A * 4/1988 Ditcher ..... E02D 29/14 156/218
5,743,673 A 4/1998 Bravo
7,153,057 B1 * 12/2006 Lucas ..... E02D 29/14 404/25

(Continued)

FOREIGN PATENT DOCUMENTS

GB 2324324 A 10/1998

*Primary Examiner* — Abigail A Risic
(74) *Attorney, Agent, or Firm* — KEATY LAW FIRM LLC; Thomas S. Keaty

(57) ABSTRACT

An underground utility enclosure system and method for installation over a junction point for underground utility conduit, cables, wires, and pipes, providing lighter less-expensive shatterproof enclosures, which can be more quickly manufactured and transported, more easily stored and handled on-site, and more easily installed with less heavy equipment and fewer personnel. A corrugated enclosure body made of a shatterproof polymer material has annular correlation, and allows for slight deformation to accommodate underground obstacles and allows on-site cutting and modification with available hand tools to adapt to different installation needs, allowing the purchase and storage of a smaller number of different sizes and configurations of enclosures to address a greater number of installation circumstances. At least three anchor loops provide for efficient handing and installation. A fitted lid available in various materials provides appropriate strength at an appropriate cost for different installation needs. The underground utility enclosure can optionally be provided as a kit.

20 Claims, 5 Drawing Sheets

(56) References Cited

U.S. PATENT DOCUMENTS

| | | | | |
|---|---|---|---|---|
| 7,381,888 | B2 * | 6/2008 | Burke | G02B 6/4451 220/4.28 |
| 7,385,137 | B2 * | 6/2008 | Burke | H02G 9/10 174/37 |
| 8,835,757 | B2 | 9/2014 | Freeman | |
| 9,127,430 | B2 * | 9/2015 | Mitchell | E02D 29/1445 |
| 9,287,693 | B2 * | 3/2016 | Burke | H02G 3/185 |
| 9,435,099 | B2 | 9/2016 | Dang | |
| 10,240,316 | B2 | 3/2019 | Dang | |
| 10,358,285 | B2 | 7/2019 | Burke et al. | |
| 2006/0065994 | A1 * | 3/2006 | Del Zotto | B28B 7/168 249/177 |
| 2009/0173397 | A1 * | 7/2009 | Mallela | F16L 5/00 137/364 |
| 2013/0055650 | A1 * | 3/2013 | Hartmann | E03B 7/095 52/124.1 |
| 2015/0210470 | A1 * | 7/2015 | Melloul | B65F 1/0006 405/129.6 |
| 2020/0223627 | A1 * | 7/2020 | Russell | B65D 90/105 |

* cited by examiner

UNDERGROUND UTILITY ENCLOSURE SYSTEM AND METHOD

BACKGROUND OF THE INVENTION

This invention provides an underground utility enclosure system and method for installation over a junction point for underground utility conduit, cables, wires, and pipes.

Utility services such as electricity, gas, water, and communications can be run underground, and are likely to be run underground in newly developed areas. Existing overhead utilities can be replaced with underground utilities. Underground utilities are distributed by pipes and by cables and wires, sometimes run through conduit and sometimes as direct-burial cable. At several points along a run of underground utilities a junction point exists where a drop to a house or building is made, where a branch is split off, where a repair or splice needs to be made, or where a booster, pump, repeater, or amplifier needs to be installed. The junction points require at least occasional access. During initial construction technicians need access to the junction points to make and test all of the connections, and later access is needed for repair, testing, and extensions.

Presently, underground utilities junction points are enclosed in utility enclosures or vaults usually made of cast concrete or composite material, which have several disadvantages. Because they are rigid cast structures, they must be made to exact fixed dimensions and configurations of openings and structures. Therefore, a very large number of enclosures having different dimensions and configurations must be made through a time-consuming and expensive casting process. Because of this, it is not unusual to see up to nine-month waiting times for a construction site to receive the exact enclosures needed. The enclosures are bulky and heavy, causing the costs of storage and transport to rise. Because the concrete or composite material is brittle and breakable, the costs and complexities of handling during transport and installation rise, and an enclosure might break at the job site during handling or installation, leaving the job site without a unique enclosure, which might take months to replace.

A contractor bidding on or working on a large installation job will have to determine the exact dimensions and configurations needed for each of the many junction points, including any junction points requiring any change from the standard specifications. And then the enclosures will have to be ordered, manufactured, transported, and stored, with the necessary handling and tracking, before installation.

Where a vault or a concrete or other brittle enclosure is used, all underground obstructions such as rocks or boulders, demolition debris, dead tree roots, or existing utilities need to be completely removed before installation of the enclosure to avoid damaging the enclosure. During installation even slight mistakes in setting the angle of placement will likely require complete re-excavation and re-setting.

The worksite will probably not receive its final grading until long after the utility enclosures have been installed and set, and any miscalculation of the eventual grade, or any subsequent changes to the landscaping plans, can result in the top of the utility enclosure being too far above or below grade. If an eventual sloping profile is planned for a worksite not yet having that profile during installation of underground utilities, mistakes in installation can result in misalignments of utility enclosures creating obstacles or hazards.

What is needed is an underground utility enclosure made of a strong non-brittle material, inexpensive, highly resistant to breakage during storage, transport, handling, installation, and long-term use, but flexible enough to allow slight deformation to accommodate obstacles and to accommodate needed adjustments, and capable of being modified on-site using basic hand tools.

U.S. Pat. No. 3,974,599 for an "Underground Reinforced Plastic Enclosure," issued on Aug. 17, 1976 to assignee Indian Head, Inc., provides for an underground reinforced plastic enclosure comprising a vertically and circumferentially stiffened body. The body is made of a fiberglass polyester resin and the stiffeners are of a reinforced plastic mortar. The body is suitable for surrounding a transformer or an oil switch used in underground utilities. On the body is seated a top cap made of reinforced plastic mortar. The top cap is formed with a central opening. Seated on the top cap is a reinforced plastic mortar cover plate or a metal grate. Depending from the top cap is a fiberglass polyester resin baffle and tamper shield. The body seats on a base of reinforced plastic mortar. A grade adjustment skirt also depends from the top cap outwardly from the baffle and tamper shield.

U.S. Pat. No. 10,240,316 for a "Locking Subgrade Vault," issued on Mar. 26, 2019 to assignee Oldcastle Precast, Inc., provides for a subgrade vault system with a locking lid assembly. Specifically, a subgrade vault suitable for housing utility and similar equipment is provided, the vault comprising a main body portion, a cap, and a lid that may be selectively secured with one or more rotatable locking mechanisms to prevent or deter unauthorized access to vault content.

U.S. Pat. No. 9,435,099 for a "Locking Subgrade Vault," issued on Sep. 6, 2016 to assignee Oldcastle Precast, Inc., provides for a subgrade vault system with a locking lid assembly. Specifically, a subgrade vault suitable for housing utility and similar equipment is provided, the vault comprising a main body portion, a cap, and a lid that may be selectively secured with one or more rotatable locking mechanisms to prevent or deter unauthorized access to vault contents.

U.S. Pat. No. 5,743,673 for a "Watertight Sealing System with Relief Valve for Manhole Having a Spill Bucket," issued on Apr. 28, 1998 to inventor Sergio M. Bravo, provides for a sealing assembly for sealing a manhole against entering liquid, and the assembly includes a support ring fixed to the manhole's skirt and a sealing member resting on the support ring. The sealing member has a base with a foam ring under it, and pressing members on top of it for pressing the base against the support ring with the foam in between. The sealing member also has a top which is flexibly connected to the base. The top is fixed to the manhole cover with a gasket between it and the cover. A relief valve is provided to prevent the enclosed space within the manhole formed by the sealing member from overpressuring.

U.S. Pat. No. 10,358,285 for a "Thermoset Polymer Utility Vault Lid," issued on Jul. 23, 2019 to assignees Channell Commercial Corporation et al., provides for a fiber reinforced polymer material lid or cover for a utility vault made from an unsaturated polyester thermosetting resin matrix, glass fiber reinforcement, an inorganic filler, and an ultraviolet inhibitor. The lid or cover has a flat textured upper surface having a plurality of bosses having different heights extending above the upper surface and a bottom surface having an outer perimeter rim with a recessed interior cavity having a number of continuous support ribs extending through the recessed interior cavity from opposite sides of the outer perimeter of the rim to transfer load placed on the lid or cover and minimize deflection under the load to the outer perimeter rim.

U.S. Pat. No. 3,672,103 for a "Modular Utility Vault," issued on Jun. 27, 1972 to assignee City of Fort Collins, provides for a modular construction for underground utility vault. Semicylindrical end sections are molded in the form of a relatively thin shell from fiberglass or other moldable material of similar physical characteristics. The shells are formed with a series of radially offset circumferentially extending ribs which provide increased rigidity to the shell and also form shelves for supporting elements such as transformers, connection points, etc. within the vault. The end section is one form of structural module which may, in some installations, be combined with a second modular element in the form of a flat side panel having a cross-sectional configuration matching that of the end section. Two end sections may be secured to each other to form a cylindrical vault or, alternatively, two end sections may be assembled with one or more pairs of side panels attached to and mounted between the opposed end sections. A cover element of laminated molded sheet material closes the opening at the upper end of the completed vault and is provided with internal stiffening ribs. A lock and retainer-hinge assembly are employed to releasably lock the cover in position and enables the cover, when unlocked, to either be swung upwardly as on a hinged mounting or removed entirely.

U.S. Pat. No. 8,835,757 for a "Locking Subgrade Vault," issued on Sep. 16, 2014 to assignee Oldcastle Precast, Inc., provides for subgrade vault system and method of forming the same. Specifically, a subgrade vault suitable for housing utility and similar equipment is provided, the vault comprising a main body portion, a cap, and a lid that may be selectively secured to prevent or deter unauthorized access to vault contents.

UK Publication No. 2 324 324 for "An Underground Chamber," published on Oct. 21, 1998 by inventors Mokhtar Kourgli et al., discloses a chamber that is suitable for installation underground, especially for the housing of roadway utilities, and the chamber includes a wall component. The wall component is constructed from plastics material and comprises a wall portion connected along a line of weakness to an edge portion. The line of weakness allows the edge portion to be foldable with respect to the wall portion of the wall component, and this edge portion may then be secured to an adjacent wall component.

SUMMARY OF THE INVENTION

This invention provides an underground utility enclosure system and method for installation over a junction point for underground utility conduit, cables, wires, and pipes. The underground utility enclosure provides lighter less-expensive shatterproof enclosures, which can be more quickly manufactured and transported, more easily stored and handled on-site, and more easily installed with less heavy equipment and fewer personnel. A corrugated enclosure body made of a shatterproof polymer material has annular correlation, and allows for slight deformation to accommodate underground obstacles and allows on-site cutting and modification with available hand tools to adapt to different installation needs, allowing the purchase and storage of a smaller number of different sizes and configurations of enclosures to address a greater number of installation circumstances. At least three anchor loops provide for efficient handing and installation. A fitted lid available in various materials provides appropriate strength at an appropriate cost for different installation needs.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
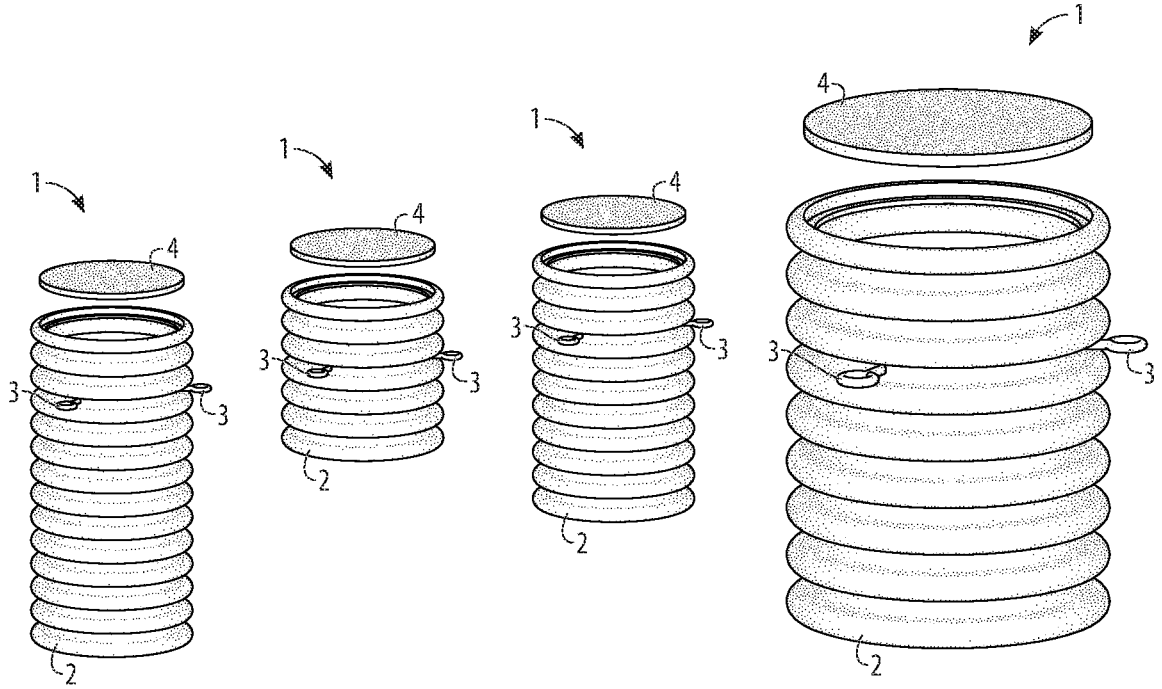
FIG. 1 is a perspective view of the underground utility enclosure of the invention in different sizes.
Figure 2:
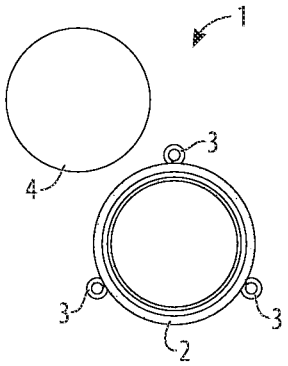
FIG. 2 is a top view of the underground utility enclosure of the invention.

Referring to FIG. 1 and FIG. 2, embodiments of the underground utility enclosure 1 of the invention are shown. The underground utility enclosure 1 can be provided in different diameter sizes and different vertical heights appropriate for different installation requirements and conditions. Because the corrugated enclosure bodies 2 of the enclosures are made from an inexpensive thermoplastic material, as treated in detail below, which can be easily cut or modified on-site during installation, a unit of the enclosure having more vertical height than needed can be easily cut down, or an opening can be cut into the side, to allow for the use of a unit already at the job site instead of having to order and wait for delivery of a differently configured unit. Because the fitted lids 4 can be made of different materials and with different bracing appropriate for different anticipated loads, as treated in detail below, and because all fitted lids 4 of a given size will fit on the same corrugated enclosure body 2 of that size, the number of different corrugated enclosure bodies 2 to be manufactured, transported, stored, and kept on-site is reduced.

The underground utility enclosure 1 provides a corrugated enclosure body 2, at least three anchor loops 3, and a fitted lid 4.

The corrugated enclosure body 2 is made from a thermoplastic polymer material having the required strength and elasticity to be molded into a corrugated tube and retain its shape while allowing for the slight deformations of the corrugated enclosure body 2 which are treated below. The thermoplastic polymer material should not have any tendency to break or shatter when dropped or struck because such dropping and striking will be a common occurrence during storage, handling, transport, installation, and use of the underground utility enclosure 1. A preferred embodiment of the corrugated enclosure body 2 is made from high-density polyethylene (HDPE) which has the needed properties, is resistant to solvents, and is available as recycled material. Other polyethylenes such as medium-density polyethylene (MDPE) are suitable, but are less common and less commonly available as recycled material. Acrylonitrile butadiene styrene (ABS) is suitable if it is treated to resist damage from ultraviolet light, but ABS is less-commonly recycled and is susceptible to damage from some solvents. Polypropylene (PP) is suitable but is vulnerable to ultraviolet radiation and is less-commonly recycled. A nylon synthetic polyamide polymer can also be suitable. The corrugated enclosure body 2 is molded as a tube having annular corrugation, which is equally spaced parallel corrugations whose main plane is perpendicular to the body axis. The corrugated enclosure body 2 has an inside surface and an outside surface. In use, installed in the ground, the corrugated enclosure body 2 has a vertical, top to bottom axial orientation. The annular corrugation provides both overall strength and some limited and controlled flexibility. The inherent slight elasticity of the thermoplastic polymer material and the flexibility provided by the annular corrugation allow for deformation of the corrugated enclosure body 2 to accommodate an obstacle or to bend the enclosure to accommodate a difference between the angle of the underground bottom portion and the desired angle of the top portion, as treated in detail below.

The underground utility enclosure 1 provides at least three anchor loops 3 arrayed around and protruding from the outside surface of the corrugated enclosure body 2. In a preferred embodiment three anchor loops 3 are arrayed around the corrugated enclosure body 2 equidistant and in a 120-degree angular relationship. Each anchor loop 3 forms a loop or an eye providing an attachment point for a rope, wire, cord, chain, or strap which can together form a harness for lowering the corrugated enclosure body 2 into a hole in the ground while allowing for exact placement and maintaining or adjusting the alignment of the main axis of the corrugated enclosure body 2, as treated in detail below. The anchor loops 3 can be provided as eye bolts or similar anchors, or as protruding loops molded, heat-welded, or otherwise affixed onto the corrugated enclosure body 2. The anchor loops 3 can also be formed from rope or strap material, either with each anchor loop attached separately to the corrugated enclosure body 2, or with the anchor loops attached to another rope or strap encircling the corrugated enclosure body 2.

The underground utility enclosure 1 provides a fitted lid 4 to cover the top of the corrugated enclosure body 2. A suitable rabbet, recess, ledge, lip, or seat is formed into the top of the corrugated enclosure body 2 to accommodate the fitted lid 4. The top of the corrugated enclosure body 2 can be reinforced with additional material where reinforcement is needed because of the size of the top opening, the weight of the lid, and the anticipated forces on the lid during use. A variety of fitted lids 4 can be provided for different anticipated loads and circumstances, which allows supplying heavy-duty and traffic-rated fitted lids 4 where needed, without increasing the costs of lighter-duty fitted lids 4. A heavy-duty, traffic-rated, or very large fitted lid 4 can be made from a strong metal or composite material or combination of materials, can be made thicker, and can have added bracing materials or bracing structures. Lighter-duty and smaller fitted lids 4 can be made from less strong materials and can be made less thick and with less bracing. Such a lighter-duty lid might be made from substantially the same thermoplastic material as the corrugated enclosure body 2. Fitted lids 4 can be provided in embodiments with or without openings or handles, and in embodiments ranging from completely sealed against water intrusion through water resistance to allowing the flow of water. In applications where the connections and junctions of the underground conduits, cables, wires, or pipes are sufficiently insulated and waterproofed, it might not be necessary to use completely sealed fitted lids 4. In applications where the fitted lid 4 and the top of the corrugated enclosure body 2 would be subject to damage from, for example, landscape maintenance equipment such as mowers, trimmers, or plows, a protective collar or bumper can be placed around or cast in place around the top of the corrugated enclosure body 2 and fitted lid 4, as treated in detail below.

Figure 3:
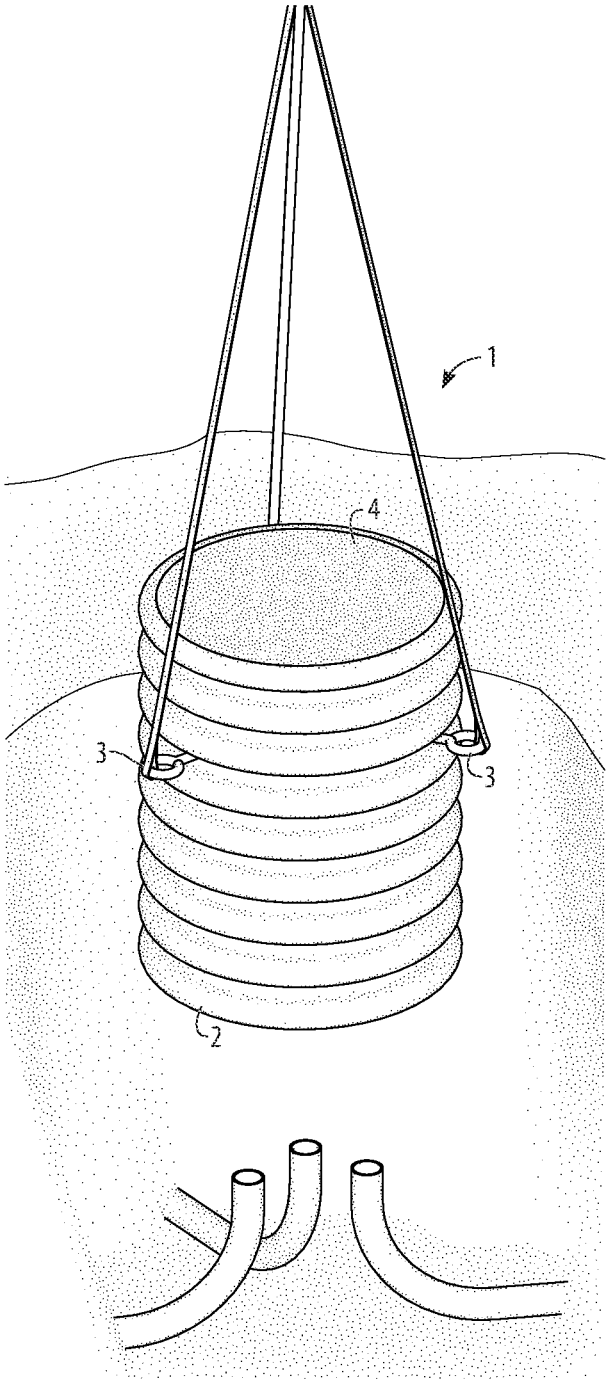
FIG. 3 is a schematic view of the underground utility enclosure of the invention in use during installation.
Figure 4:
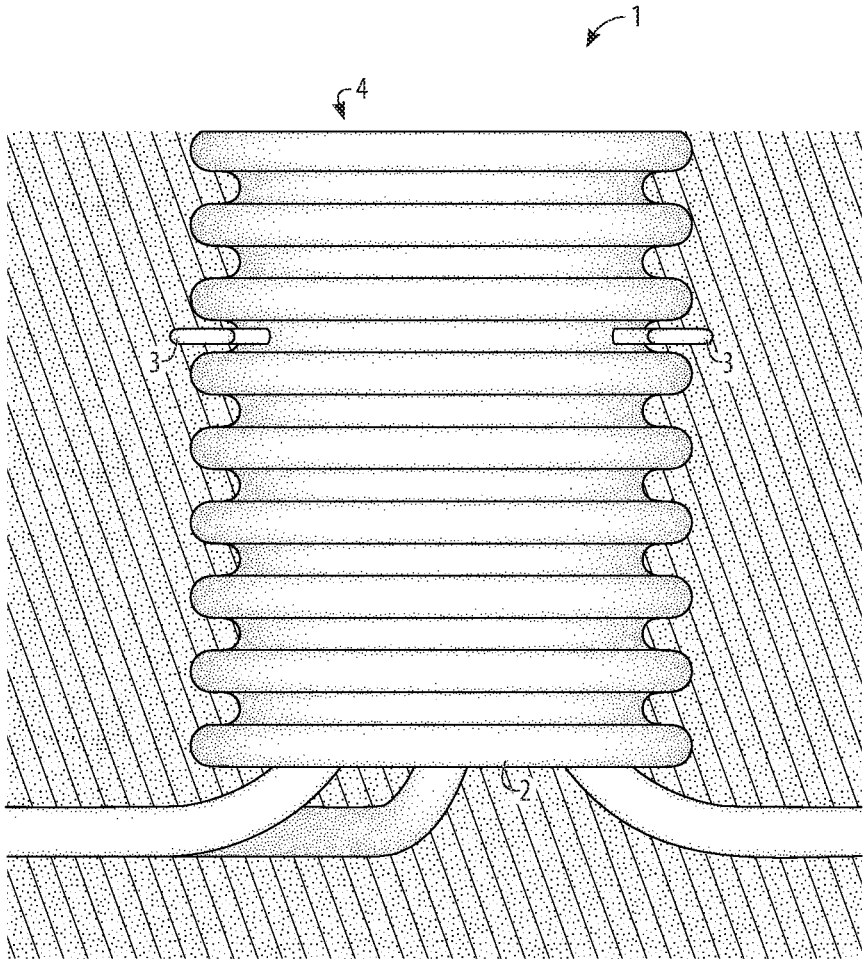
FIG. 4 is a section side view of the underground utility enclosure of the invention in use after installation.

Referring to FIG. 3 and FIG. 4, in normal use, at a construction job site, runs of conduit, pipe, direct-burial cable, and related utilities infrastructure will have been buried underground and will terminate at junction points where, for example, the drop for a particular structure, location, or branch might be taken off, or where long runs need to be spliced together, possibly with some kind of pump, repeater, or amplifier. At the junction points the underground conduit, pipes, or cables will emerge into a hole, often, but not always with a long ninety-degree upward bend. In other uses a new junction point might be made into existing underground utilities in order to create a new drop or branch, to splice or repair damage, or to add a needed booster. With the underground utility enclosure 1 of this invention, the burial of the underground conduit, pipes, and cables, with the raw terminations at junction points, can be done prior to and independent of the installation of the utility enclosure, which can later be placed over the terminations. Terminations approaching at odd angles or at higher levels can be accommodated by slightly deforming or by cutting into the corrugated enclosure body 2, as treated in detail below. The joining, splicing, and connecting of the utilities at the junction point can be done either before or after installation of the underground utility enclosure 1, and is usually done afterward.

The corrugated enclosure body 2 will be placed into the hole and over the terminations at the junction point. The anchor loops 3 provide for the attachment of ropes, wires, cords, chains, or straps as a harness for lifting and lowering the underground utility enclosure 1 into the hole, for adjusting the position and angle during installation, and for stabilizing the position and angle during backfilling of the hole. Because of the at least three anchor loops 3 arrayed around the corrugated enclosure body 2 equidistant and in a 120-degree angular relationship, a properly configured harness should hold the corrugated enclosure body 2 in a substantially vertical position, and manipulation of the separate legs of the harness can adjust or correct the angle. The hole is backfilled to complete the installation of the underground utility enclosure 1.

For smaller embodiments of the underground utility enclosure 1, because of the relatively light weight and resistance to damage during handling, the underground utility enclosure 1 can be installed by hand by one or two persons, either directly manipulating the anchor loops 3 or using a small harness. Also because of the relatively light weight and resistance to handling damage, large embodiments of the underground utility enclosure 1 can be installed using less-powerful lifting equipment than would be required for heavier easily damaged enclosures.

After installation and backfilling of the hole, if the positioning of the underground utility enclosure 1 needs to be adjusted, as might be needed if, for example, the landscaping plan for the site is significantly altered, the hole can be partially re-excavated at least to expose the anchor loops 3, a harness can be re-attached, and the underground utility enclosure 1 can be re-positioned, or can be removed and replaced.

Figure 5:
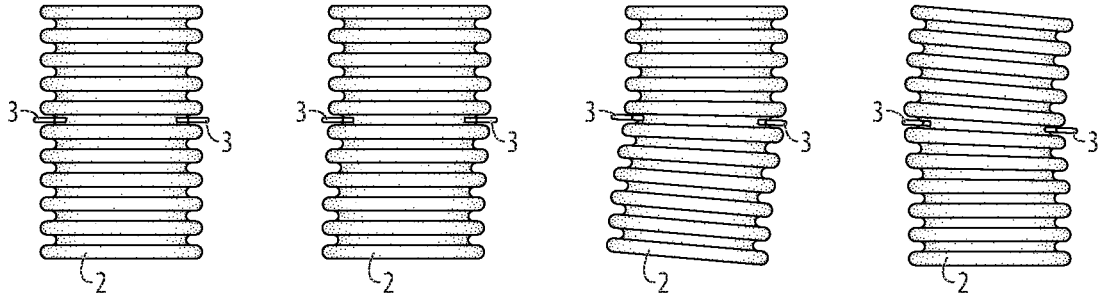
FIG. 5 is a side view of units of the underground utility enclosure of the invention showing deformations to accommodate irregularities in installation.

Referring to FIG. 5, because of the inherent slight elasticity of the thermoplastic polymer material and the flexibility provided by the annular corrugation, the corrugated enclosure body 2 can be deformed to accommodate an obstacle or to bend the enclosure to accommodate a difference between the angle of the underground bottom portion and the desired angle of the top portion, as illustrated where the top portion and the bottom portion of the installed corrugated enclosure body 2 can be in straight alignment, where the bottom portion can be offset to avoid an obstacle or to enclose a wrongly placed termination, where the bottom portion can be set at an angle and the top portion can be returned to vertical, or where the top portion can be placed at an angle to conform to a sloping grade.

Figure 6:
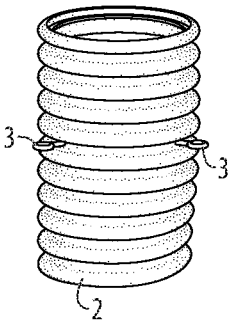
FIG. 6 is a perspective view of a unit of the underground utility enclosure of the invention showing deformation to accommodate an obstruction.

Referring to FIG. 6, the corrugated enclosure body 2 can be deformed by compression in order to accommodate an obstacle or a utility termination which is too high.

Figure 7:
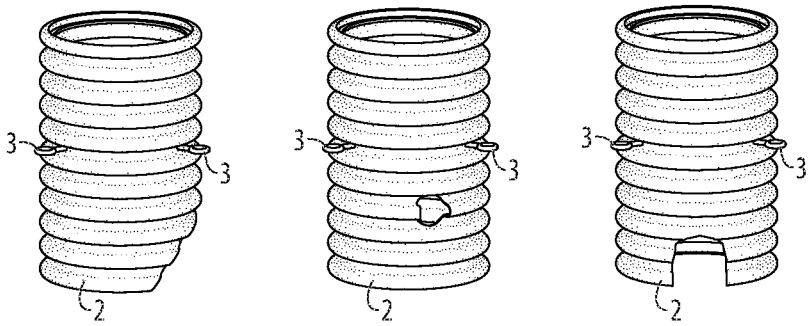
FIG. 7 is a perspective view of units of the underground utility enclosure of the invention showing removal of portions of the corrugated enclosure body to accommodate obstructions and provide access at higher levels than the bottom.

Referring to FIG. 7, portions of the corrugated enclosure body 2 can be cut away or cut into, on-site using standard hand tools, in order to avoid an obstacle or to allow entry of a utility termination or the pass-through of a utility run which is higher than the bottom of the corrugated enclosure body 2.

Figure 8:
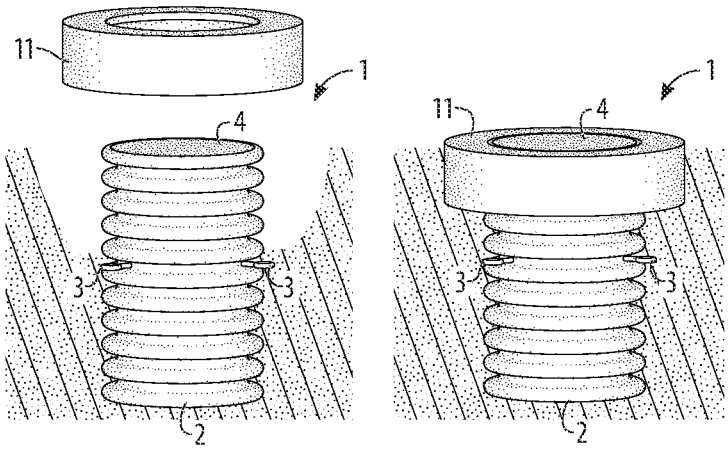
FIG. 8 is a perspective sequential view of an embodiment of the underground utility enclosure of the invention with a protective collar installed.

Referring to FIG. 8, in an optional embodiment of the underground utility enclosure 1, a protective collar 11 can be provided and placed around the top portion of the corrugated enclosure body 2, protecting the top portion of the enclosure body and the fitted lid 4 from damage, shifting, or other disturbance which might be caused by traffic or by landscape maintenance equipment such as mowers, trimmers, or plows. The protective collar 11 can stabilize the top of the corrugated enclosure body 2 and the fitted lid 4 from unwanted lateral deformation and compression, and can also stabilize and fix in place intentional deformations created during installation, such as a change of angle to conform to a sloping grade. The top surface of the protective collar 11 could also be re-shaped to provide a transition to conform to special conditions or to, for example, slope upward to a raised top portion and fitted lid 4 to prevent water pooling or slope downward to avoid damage. The inner surface of the protective collar 11 matches and conforms to the outer surface of the top portion of the corrugated enclosure body 2, providing a close fit. The protective collar 11 can be made from a variety of materials, including the same materials chosen for the corrugated enclosure body 2 or the fitted lid 4. The protective collar 11 can be provided in colors and appearance to match the installation site or to contrast with the site as a visual warning. To install the protective collar 11, after installation of the corrugated enclosure body 2, the hole is only partially backfilled, or if it has been completely backfilled, a trench to accommodate the protective collar 11 is re-excavated. The protective collar 11 is then placed upon the corrugated enclosure body 2, with the inner surface of the protective collar 11 fitted closely with the outer surface of the top portion of the corrugated enclosure body 2.

Figure 9:
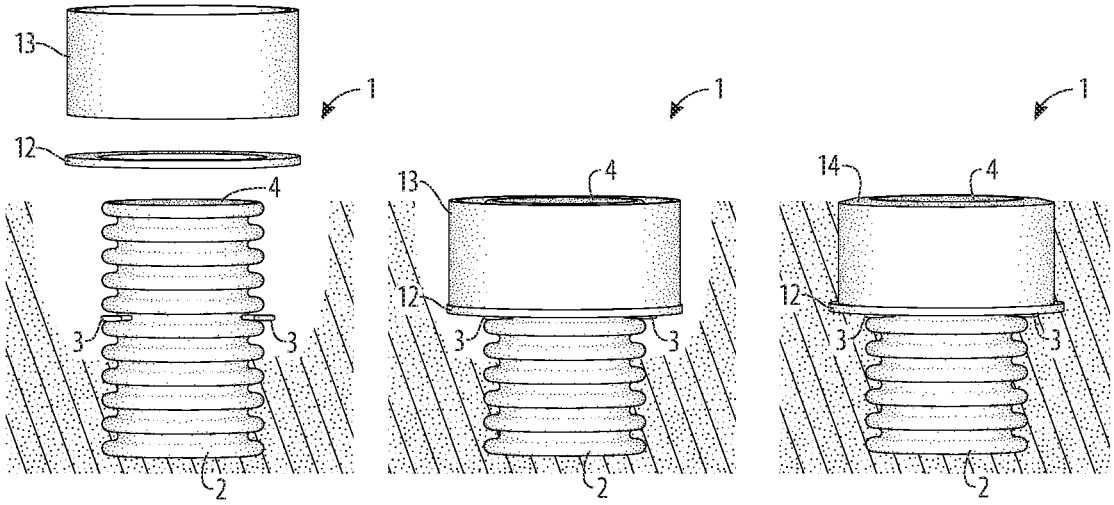
FIG. 9 is a perspective sequential view of an embodiment of the underground utility enclosure of the invention with a poured concrete bumper installed.

Referring to FIG. 9, in an optional embodiment of the underground utility enclosure 1, a cast bumper 14 made of concrete or of resin or similar material can be formed by casting, around the top portion of the corrugated enclosure body 2. The bumper protects the top portion of the enclosure body and the fitted lid 4, as with the protective collar 11 treated above. The cast bumper 14 is cast on site after installation, which allows for modifications appropriate for a specific site or specific use, such as size, profile, reinforcement, and tying into adjacent surfaces or structures. The concrete can be a standard cementitious concrete or a non-cementitious concrete such as asphalt concrete and polymer concrete. A resin or a silicone rubber capable of being cast could also be used. This optional embodiment provides a casting-form base 12 and a casting-form tube 13 to be used for casting the bumper in place after installation of the corrugated enclosure body 2. The casting-form base 12 and casting-form tube 13 can be made from stiff cardboard, from a wood or composite laminate, from a plastic, or from a metal. After installation of the corrugated enclosure body 2 the hole is only partially backfilled, or if it has been completely backfilled, a trench to accommodate the casting of the bumper is re-excavated. The casting-form base 12 is placed around the corrugated enclosure body 2 and is lowered to an appropriate depth below grade. As illustrated the casting-form base 12 can rest upon and be supported by the anchor loops 3. If a more shallow placement is desired, spacers can be used between the anchor loops 3 and the casting-form base 12, or the anchor loops 3 can be disregarded and the casting-form base can be temporarily set in place by another method. If it is desired to cast the bumper down to a level deeper than the anchor loops 3, the casting-form base 12 can be forced downward past the anchor loops, or the casting-form base 12 can be omitted, allowing the concrete to flow to the bottom of the hole. The casting-form tube 13 is then placed around the corrugated enclosure body 2 and is lowered to the casting-form base 12 or to another stopping point. The concrete or other casting material is then poured into the space between the casting-form tube 13 and the corrugated enclosure body 2. After the casting material hardens the casting-form 13 can be removed or optionally can be left in place. The cured casting material forms the cast bumper 14 which protects and stabilizes the underground utility enclosure 1.

Figure 10:
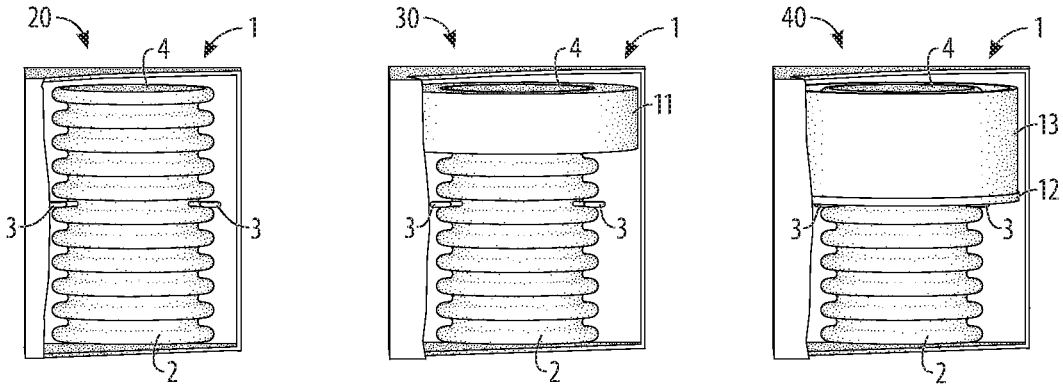
FIG. 10 is a perspective view of three embodiments of the underground utility enclosure of the invention provided in kit form.

Referring to FIG. 10, the constituent parts of the underground utility enclosure 1 can be provided as a kit 20, 30, 40 for an installation of the underground utility enclosure 1. A basic kit 20 embodiment provides the corrugated enclosure body 2 with anchor loops 3 and the fitted lid 4. A collar kit 30 embodiment provides the corrugated enclosure body 2, anchor loops 3, and fitted lid 4, and additionally provides the protective collar 11. A casting kit 40 embodiment provides the corrugated enclosure body 2, anchor loops 3, and fitted lid 4, and additionally provides the casting-form base 12 and casting-form tube 13.

Many other changes and modifications can be made in the system and method of the present invention without departing from the spirit thereof. I therefore pray that my rights to the present invention be limited only by the scope of the appended claims.

I claim:

1. An underground utility enclosure comprising:

(i) a corrugated enclosure body configured to protect a junction of underground utility sections and is installable without a concrete casting, said body being made of a polymeric shatterproof material adaptable to slight vertical and lateral deformations of the enclosure body to accommodate underground obstacles and irregular terrain, said body having circumferential annular corrugations, inside and outside surfaces, and a vertical top to bottom axial orientation in use;

(ii) at least three anchor loops arrayed around and protruding from the outside surface of said corrugated enclosure body; and (iii) a fitted lid adapted to cover the top of said corrugated enclosure body, said lid being constructed of materials suitable to withstand site-specific environmental and operational loads, said corrugated enclosure body configured to protect the fitted lid from displacement under such loads.

2. The underground utility enclosure of claim 1, where said corrugated enclosure body further comprises a polymer material.

3. The underground utility enclosure of claim 1, where said corrugated enclosure body further comprises a thermoplastic polymer material.

4. The underground utility enclosure of claim 1, where said corrugated enclosure body further comprises HDPE material.

5. The underground utility enclosure of claim 1, where said anchor loops are further arrayed around said corrugated enclosure body in an equidistant 120-degree angular relationship, said anchor loops facilitating handling and installation of said enclosure.

6. The underground utility enclosure of claim 1, where said corrugated enclosure body is further reinforced at the top portion to provide additional support for said fitted lid, the reinforcement being selected based on the size of the top opening, the weight of the lid, and the anticipated forces on the lid during use.

7. The underground utility enclosure of claim 1, where said fitted lid further comprises a metal material preventing displacement or deformation under repeated above-ground impacts.

8. The underground utility enclosure of claim 1, further comprising a protective collar positioned at the top of the enclosure, said protective collar protecting the top portion of the enclosure body and the fitted lid from damage and displacement caused by site-specific environmental loads and stabilizing intentional or unintentional deformations.

9. The underground utility enclosure of claim 1, further comprising a cast bumper positioned around the top portion of the corrugated enclosure body, said cast bumper protecting the top portion of the enclosure body and the fitted lid from damage and displacement caused by site-specific environmental loads.

10. An underground utility enclosure method comprising:

(i) providing an excavated hole at a junction point;

(ii) providing an underground utility enclosure comprising:

(a) a corrugated enclosure body configured to protect a junction of underground utility sections and is installable without a concrete casting, said body being made of a polymeric shatterproof material adaptable to slight vertical and lateral deformations of said body to accommodate underground obstacles and irregular terrain, said body having annular corrugations, inside and outside surfaces, and a vertical top to bottom axial orientation in use;

(b) at least three anchor loops arrayed around and protruding from the outside surface of said corrugated enclosure body; and (c) a fitted lid adapted to cover the top of said corrugated enclosure body, said lid being constructed of materials suitable to withstand site-specific environmental and operational loads, said corrugated enclosure body configured to protect the fitted lid from displacement under such loads a fitted lid adapted to cover the top of said corrugated enclosure body;

(iii) lowering said underground utility enclosure into said excavated hole using said anchor loops; and (iv) backfilling said excavated hole.

11. The underground utility enclosure method of claim 10, further comprising providing a protective collar positioned at the top of the enclosure, said protective collar protecting the top portion of the enclosure body and the fitted lid from damage and displacement caused by site-specific environmental loads, and installing said protective collar.

12. The underground utility enclosure method of claim 10, further comprising providing a cast bumper having a casting-form base and casting-form tube, placing said casting-form base and casting-form tube upon said underground utility enclosure, pouring concrete into said casting-form tube, and using the cast bumper for protecting the top portion of the enclosure body and the fitted lid from damage and displacement caused by site-specific environmental loads, while allowing for modifications appropriate for a specific site or specific use on site.

13. The underground utility enclosure method of claim 10, further comprising a step of allowing slight vertical and lateral deformations of said enclosure body to accommodate underground obstacles and irregular terrain.

14. The underground utility enclosure method of claim 10, further comprising a step of deforming said corrugated enclosure body slightly in a vertical and lateral direction to adapt the top of said corrugated enclosure body into alignment with the bottom of said corrugated enclosure body.

15. The underground utility enclosure method of claim 10, further comprising a step of deforming said corrugated enclosure body slightly in a vertical or lateral direction to adapt the top of said corrugated enclosure body to a sloping grade.

16. The underground utility enclosure method of claim 10, further comprising cutting said corrugated polymer enclosure body in the field to create openings or offsets that accommodate underground obstacles and irregular terrain.

17. The underground utility enclosure method of claim 10, further comprising a step of cutting said corrugated polymer enclosure body in the field to create additional openings that provide access to the interior of said corrugated enclosure body, said cutting step being performed to adapt the enclosure body to underground obstacles, irregular terrain, or site-specific installation requirements.

18. An underground utility enclosure kit comprising a corrugated enclosure body configured to protect a junction of underground utility sections and installable without a concrete casting, said body being made of a shatterproof polymer material adaptable to slight vertical and lateral deformations to accommodate underground obstacles and site-specific environmental loads, at least three external anchor loops protruding outwardly from the enclosure body for handling and installation, and a fitted lid adapted to cover the top of said corrugated enclosure body, said lid being constructed of materials suitable to withstand site-specific environmental and operational loads, said corrugated enclosure body configured to protect the fitted lid from displacement under such loads and protect the junction from environmental exposure.

19. The underground utility enclosure kit of claim 18, further comprising a protective collar positioned at the top of the enclosure, said protective collar protecting the top portion of the enclosure body and the fitted lid from damage and displacement caused by site-specific environmental loads.

20. The underground utility enclosure kit of claim 18, further comprising a cast bumper positioned around the top portion of the corrugated enclosure body, said cast bumper protecting the top portion of the enclosure body and the fitted lid from damage and displacement caused by site-specific environmental loads, said cast bumper comprising a casting-form base and a casting-form tube.

* * * * *